United States Patent [19]

Sickler

[11] 4,164,346

[45] Aug. 14, 1979

[54] LAP SIDING TOOL

[76] Inventor: Jack R. Sickler, P.O. Box 20803, Billings, Mont. 59104

[21] Appl. No.: 907,287

[22] Filed: May 18, 1978

[51] Int. Cl.[2] ..... B23Q 3/02

[52] U.S. Cl. ..... 269/321 S; 33/188; 145/1 A

[58] Field of Search ..... 269/321 S, 102, 97–98, 269/289 MR, 45, 303–304, 319; 33/187, 188; 52/748, 474, 127, 547–549; 145/1 A, 1 B, 1 R; 29/281.5; 254/190–198

[56] References Cited

U.S. PATENT DOCUMENTS

| | | | |
|---|---|---|---|
| 359,025 | 3/1887 | McDonald | 254/198 |
| 692,864 | 2/1902 | Lantz | 254/194 |
| 1,292,545 | 1/1919 | Wanamaker | 254/194 |
| 2,889,632 | 6/1959 | Longhi | 33/188 |
| 3,309,822 | 3/1967 | Dunkin | 52/549 |
| 3,792,852 | 2/1974 | Reniker | 145/1 R X |
| 3,904,184 | 9/1975 | Krueger | 269/102 |

*Primary Examiner*—Robert C. Watson

*Attorney, Agent, or Firm*—Clarence A. O'Brien; Harvey B. Jacobson

[57] ABSTRACT

An upstanding body is provided having front and rear sides and the upper end portion of the body includes downwardly facing abutment surface portions spaced slightly outwardly of the rear side of the body while the lower end portion of the body includes lower upwardly facing abutment surface portions spaced outwardly of the front side of the body. The lower end portion of the body defines an upwardly opening generally horizontal channel forwardly of and extending across the front side of the body and in which to embracingly receive a lower marginal edge portion of a siding member. The upwardly facing abutment surface portions are disposed within the channel and comprise the upper peripheral portions of a roller journaled from the body within the channel for rotation about a horizontal axis extending in a front to rear direction relative to the body. The upper end of the body includes a crosshead secured to the rear side thereof and the downwardly facing abutment surface portions comprise upstanding abutment screws threadedly secured downwardly through the opposite ends of the crosshead.

15 Claims, 4 Drawing Figures

LAP SIDING TOOL

BACKGROUND OF THE INVENTION

Various forms of holder-gages have been heretofore provided for determining the proper relative positioning and overlap of adjacent portions of siding members. Examples of these various forms of holder-gages are disclosed in U.S. Pat. Nos. 132,159, 367,574, 2,446,950, 2,818,387, 3,490,152 and 3,904,184. However, most of these holder-gages are either not provided for ready support from the last course of siding applied or are not constructed in a manner whereby siding members of the next course may be readily longitudinally, horizontally shifted along the associated building wall into proper position for securement thereto. Accordingly, a need exists for a siding holder-gage which may be readily used by a single person in properly relatively positioning and determining the desired overlap of adjacent courses of siding members.

BRIEF DESCRIPTION OF THE INVENTION

The tool of the instant invention comprises an upstanding rigid strap-type body including front and rear sides. An upper crosshead is secured to the upper portion of the rear side of the body and includes vertical abutment screws adjustably downwardly threaded through opposite end portions of the crosshead for abutting engagement of the lower ends of the abutment screws with the upper marginal edge of the last course of siding members applied. The lower end of the body terminates downwardly in a horizontally forwardly directed portion which in turn terminates forwardly in an upturned terminal end portion. The lower end of the body thereby defines a horizontal channel extending across the front face of the body and a support roller is journaled within the channel for rotatation about an axis extending in a front to rear direction relative to the body. The upper peripheral portion of the roller defines an upwardly facing abutment surface upon which the lower edge of an upper course siding member may rest and when the tool is used in pairs opposite end portions of an elongated siding member may be rollingly supported from the rollers of the tools, while the supported siding member is properly vertically positioned relative to the last installed course of siding members, for ease in longitudinally shifting the supported siding member into the desired position for securement to the corresponding wall and the course of siding members disposed immediatly therebelow.

The main object of this invention is to provide a holder-gage for lap siding members and which may be readily utilized in properly positioning the siding members of a course of siding members being installed relative to the last installed course of siding members.

Another object of this invention is to provide a tool in accordance with the preceding object and constructed in a manner whereby the tool may be readily adjusted in order to adjustably vary the overlap of the courses of siding members installed by use of the tool.

Another important object of the invention is to provide a tool that will assist a single person in properly applying siding with a minimum of effort.

A further object of this invention is to provide a tool which may also be utilized to advantage by a crew of workmen applying siding.

A final object of this invention to be specifically enumrated herein is to provide a holder-gage for lap siding in accordance with the preceding objects and which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
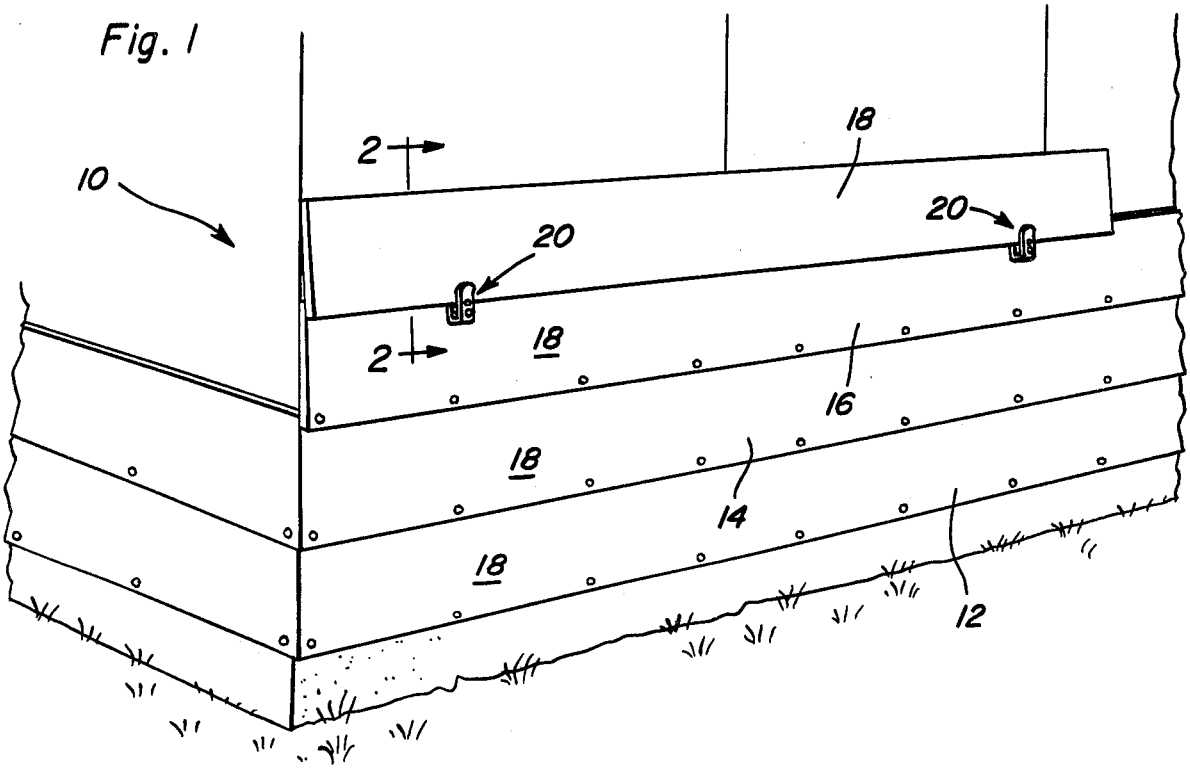
FIG. 1 is a fragmentary, perspective view of a corner portion of a building to which lap siding is being applied and with one lap siding member being held in proper position by a pair of tools of the instant invention for securement to the building and the next lower course of lap siding members.
Figure 2:
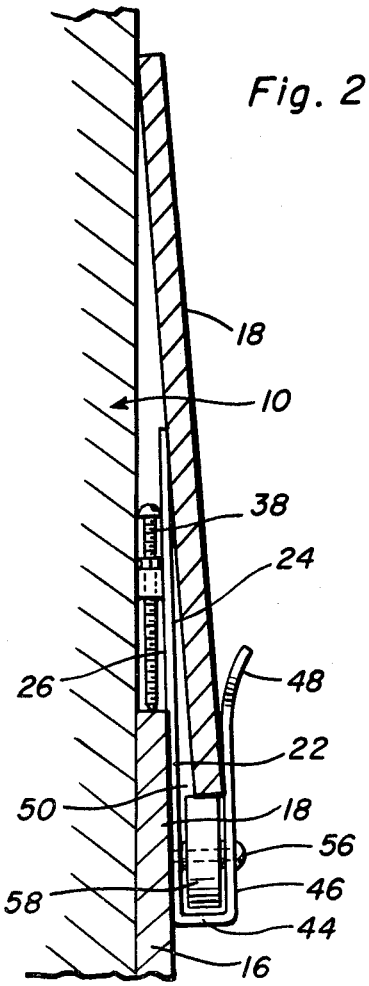
FIG. 2 is an enlarged, fragmentary, vertical sectional view taken substantially upon the plane indicated by the section line 2—2 of FIG. 1.
Figure 3:
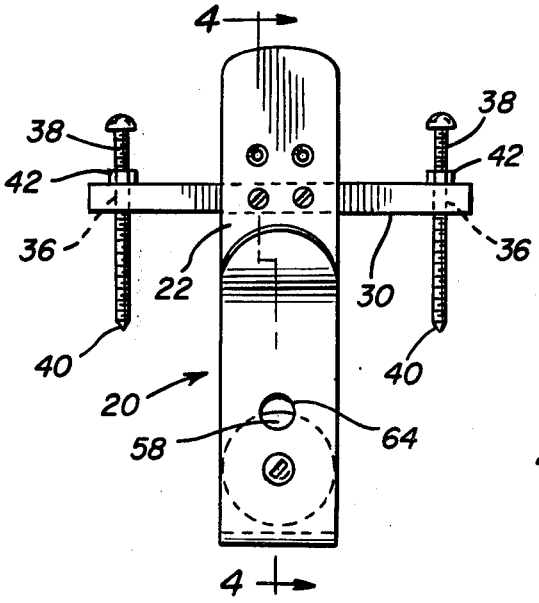
FIG. 3 is a front elevational view of the tool.
Figure 4:
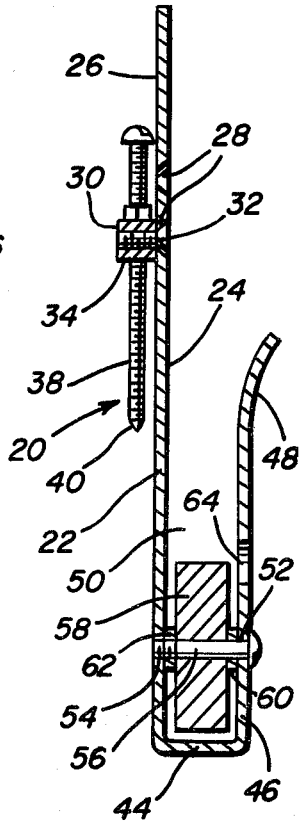
FIG. 4 is an enlarged, vertical sectional view taken substantially upon the plane indicated by the section line 4—4 of FIG. 3.

Referring more specifically to the drawings, the numeral 10 generally designates a building to one wall of which three layer courses 12, 14 and 16 of lap siding members 18 have been secured in proper overlapped relation and with a pair of tools of the instant invention illustrated in use supporting a lap siding member 18 of the next upper course of siding members in proper position for securement to the building and the upper course 16 of siding members 18.

The tool is referred to in general by the reference numeral 20 and comprises an upstanding rigid strap-type body 22 including front and rear sides 24 and 26.

The upper end portion of the body includes vertically spaced pairs of transversely spaced countersunk bores 28 formed therethrough and an elongated horizontal crosshead 30 is secured to the rear side 26 of the body 22 in selected vertical position thereon by means of fasteners 32 secured through the bores 28 and threaded bores 34 spaced along the midportion of the crosshead 30. The opposite end portions of the crosshead 30 include threaded vertical bores 36 formed therethrough and threaded abutment screws 38 are downwardly threaded through the bores 36 and include pointed lower ends 40. In addition, the screws 38 have jam nuts 42 threaded thereon above the crosshead 30 whereby the abutment screws 38 may be tightened in adjusted position relative to the crosshead 30.

The lower end of the body 22 terminates downwardly in an integral forwardly directed horizontal portion 44 and the horizontal portion 44 terminates forwardly in an upturned terminal end 46 which is curved slightly outwardly at its upper end as at 48. A horizontal channel 50 is defined between the inner side of the terminal end 46 and the opposing lower portion of the front side 24. The terminal end 46 and the lower end portion of the body 22 include horizontally registered smooth and threaded bores 52 and 54, respectively, formed therethrough and a threaded shank-type fastener 56 rotatably journals a roller 58 within the lower portion of the channel 50. The headed end portion of the fastener 56 is received through the smooth bore 52 and the threaded end of the fastener 56 remote from the head end thereof is threadedly engaged in the bore 54, a pair of washers 60 and 62 being disposed on the fastener 56 at opposite ends of the roller 58 between the latter and the terminal end 46 and the lower end of the body 22, respectively. The upper forwardly curving portion 48 of the terminal end 46 defines a flaring mouth for the open side of the channel 50 and the terminal end 46 additionally includes a viewing aperture 64 formed therethrough in registry with the upper periphery of the roller 58.

In use, a pair of tools 20, after the adjusting screws 38 have been properly adjusted and secured in adjusted position by means of the jam nut 42, are positioned over the outer side of the upper course 16 of siding members 18 with the pointed lower ends 40 of the abutment screws 38 abutted against and supported from the upper marginal edge of the course 16 of siding members 18. With the tools 20 thus positioned and the rear side of the lower end portion of the body 22 overlying the upper marginal edge of the forward surface of the course 16 of siding members, the siding member 18 of the next upper course of siding members has the opposite ends of the lower marginal edge thereof downwardly seated in the channels 50 of the tools 20 and supported from the rollers 58. Thus positioned, the siding member 18 above the course 16 is positioned in proper elevation to the course 16 and may be longitudinally shifted as required into the proper position for installation on the building 10. At this point, a pair of nails may be driven through longitudinally spaced central portions of the siding member supported from the tools 20, through the corresponding upper marginal portion of the course 16 and into the associated wall of the building 10. At this point, the proper positioning of the siding member 18 as determined by the tools 20 will be established and the opposite end portions of the tool supported siding member may be slightly outwardly flexed from the building 10 in order that the tools 20 may be removed and the remainder of the lower marginal edge portion of the uppermost siding member 18 may be secured in position by further nailing.

Of course, by utilizing a pair of the tools 20, a single workman may readily properly apply lap siding to the building 10. Also, the adjustment screws 38 as well as the adjustability of the crosshead 30 vertically along the body 22 enable the tool to be adjusted according to different width siding members.

Other than the fasteners 32 and 56 and the abutment screws 38 and nuts 42, the tool 20 may be constructed of inexpensive plastic. However, if the tool is to be marketed to persons who install lap siding professionally, the tool may have the various components thereof constructed of durable metals.

By spacing the abutment screws 38 along the crosshead 30 on and spaced outwardly from opposite sides of the body 22, each tool 20 is supported from the upper marginal edge of the course 16 in a stable manner, whereby longitudinal shifting of the supported lap siding member over the rollers 58 will be ineffective to cock either tool, even though one or both rollers may, for some reason, resist free rotation.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A tool for use in pairs to assist in properly positioning successive courses of siding members whereby to maintain the desired overlap of successive pairs of adjacent courses of siding members, said tool including an upstanding body having front and rear sides, the upper end portion of said body having upper downwardly facing abutment surface means spaced slightly outwardly of said rear side and the lower end portion of said body including lower upwardly facing support roller means journalled from said body for rotation about a generally horizontal front-to-rear extending axis and with said support roller means spaced outwardly of the front side of said body, said tool being free of portions thereof blocking vertical downward access to said roller support means from a point spaced above the uppermost extremity of said body, said abutment surface means being widely spaced on opposite sides of a vertical plane containing said axis.

2. A tool for use in pairs to assist in properly positioning successive courses of siding members whereby to maintain the desired overlap of successive pairs of adjacent courses of siding members, said tool including an upstanding body having front and rear sides, the upper end portion of said body having upper downwardly facing abutment surface means spaced slightly outwardly of said rear side and the lower end portion of said body including lower upwardly facing abutment surface means spaced outwardly of the front side of said body, the lower end portion of said body including means defining an upwardly opening generally horizontal channel forwardly of and extending across said front side and in which to embracingly receive a lower marginal edge portion of a siding member, said lower upwardly facing abutment surface means being disposed within said channel, said lower upwardly facing abutment surface means comprising the upper peripheral portion of a roller supported for rotation relative to said body about a horizontal axis extending in a front-to-rear direction relative to said body, said tool being free of portions thereof blocking vertical downward access to said roller from a point spaced above the uppermost extremity of said body, said abutment surface means being widely spaced on opposite sides of a vertical plane containing said axis.

3. The combination of claim 2 wherein said roller is positioned within said channel between the open upper side thereof and the bottom of said channel.

4. A tool for use in pairs to assist in properly positioning successive courses of siding members whereby to maintain the desired overlap of successive pairs of adjacent courses of siding members, said tool including an upstanding body having front and rear sides, the upper end portion of said body having upper downwardly facing abutment surface means spaced slightly outwardly of said rear side and the lower end portion of said body including lower upwardly facing abutment surface means spaced outwardly of the front side of said body, the lower end portion of said body including means defining an upwardly opening generally horizontal channel forwardly of and extending across said front side and in which to embracingly receive a lower marginal edge portion of a siding member, said lower upwardly facing abutment surface means being disposed within said channel, said lower upwardly facing abutment surface means comprising the upper peripheral portion of a roller supported for rotation relative to said body about a horizontal axis extending in front-to-rear direction relative to said body, the upper end portion of said body including a horizontal crosshead portion, said upper downwardly facing abutment surface means including abutment members supported from said crosshead for adjustable vertical shifting relative thereto and including downwardly facing lower abutment surfaces disposed in a vertical plane spaced rearwardly of said rear side.

5. The combination of claim 4 wherein said crosshead portion includes a horizontal bar secured to and overlapping the rear side of said body.

6. The combination of claim 4 wherein said abutment members include upstanding abutment screws threadedly secured through said crosshead, the lower ends of said abutment screws comprising said abutment surfaces.

7. The combination of claim 4 wherein said body and crosshead including coacting means operative to adjustably secure said crosshead to said body in selected positions spaced vertically therealong.

8. The combination of claim 7 wherein said crosshead portion includes a horizontal bar secured to and overlapping the rear side of said body.

9. The combination of claim 8 wherein said abutment members include upstanding abutment screws threadedly secured through said crosshead, the lower ends of said abutment screws comprising said abutment surfaces.

10. A tool to assist in properly positioning successive courses of siding members whereby to maintain the desired overlap of successive pairs of adjacent courses of siding members, said tool including an upstanding body having upper and lower end portions and front and rear sides, upwardly facing support roller means journalled from and forward of a lower portion of said body for rotation about a front to rear extending generally horizontal axis, said upper portion of said body including abutment means disposed rearward of a first plane generally normal to said axis and containing said lower body portion, said abutment means including downwardly facing abutment surface portions rearward of said first plane and widely spaced on opposite sides of a second upstanding plane containing said axis, said tool being free of portions thereof blocking vertical downward access to said roller means from a point spaced above the uppermost extremity of said body.

11. The combination of claim 10 wherein the lower end portion of said body includes means defining an upwardly opening generally horizontal channel forwardly of and extending across the front side and in which to embracingly receive a lower marginal edge portion of a siding member, said support roller means being disposed within said channel.

12. A tool to assist in properly positioning successive courses of siding members whereby to maintain the desired overlap of successive pairs of adjacent courses of siding members, said tool including an upstanding body having upper and lower end portions and front and rear sides, upwardly facing support roller means journalled from and forward of a lower portion of said body for rotation about a front to rear extending generally horizontal axis, said upper portion of said body including abutment means disposed rearward of a first plane generally normal to said axis and containing said lower body portion, said abutment means including downwardly facing abutment surface portions rearward of said first plane and widely spaced on opposite sides of a second upstanding plane containing said axis, said abutment means including means operative to selectively vertically adjustably shift said abutment surface portions relative to said body.

13. The combination of claim 10 wherein said abutment surface means includes means operative to selectively simultaneously vertically adjust said abutment surface portions relative to said body.

14. The combination of claim 13 wherein said abutment means includes means operative to selectively independently vertically adjustably shift said abutment surface portions relative to said body.

15. The combination of claim 10 wherein said abutment means includes a horizontal cross head portion secured to and overlapping the rear side of said body, said abutment surface comprising the lower ends of upstanding abutment screws threadedly secured through opposite ends of said cross head.

* * * * *